US006958101B2

(12) United States Patent
Mendenhall et al.

(10) Patent No.: US 6,958,101 B2
(45) Date of Patent: Oct. 25, 2005

(54) SUBSTITUTED BASIC METAL NITRATES IN GAS GENERATION

(75) Inventors: Ivan V. Mendenhall, Providence, UT (US); Robert D. Taylor, Hyrum, UT (US)

(73) Assignee: Autoliv ASP, Inc., Ogden, UT (US)

( * ) Notice: Subject to any disclaimer, the term of this patent is extended or adjusted under 35 U.S.C. 154(b) by 173 days.

(21) Appl. No.: 10/412,530

(22) Filed: Apr. 11, 2003

(65) Prior Publication Data

US 2004/0200554 A1 Oct. 14, 2004

(51) Int. Cl.[7] ..... C06B 31/00
(52) U.S. Cl. ..... 149/45
(58) Field of Search ..... 149/36, 45

(56) References Cited

U.S. PATENT DOCUMENTS

| | | | | |
|---|---|---|---|---|
| 4,369,079 | A | | 1/1983 | Shaw |
| 4,948,439 | A | | 8/1990 | Poole et al. |
| 5,197,758 | A | | 3/1993 | Lund et al. |
| 5,431,103 | A | | 7/1995 | Hock et al. |
| 5,467,715 | A | | 11/1995 | Taylor et al. |
| 5,472,535 | A | | 12/1995 | Mendenhall et al. |
| 5,529,647 | A | | 6/1996 | Taylor et al. |
| 5,629,494 | A | * | 5/1997 | Barnes et al. ..... 149/36 |
| 5,756,929 | A | | 5/1998 | Lundstrom et al. |
| 6,017,404 | A | | 1/2000 | Lundstrom et al. |
| 6,123,790 | A | | 9/2000 | Lundstrom et al. |
| 6,132,537 | A | | 10/2000 | Zeuner et al. |
| 6,383,318 | B1 | | 5/2002 | Taylor et al. |
| 6,475,312 | B1 | | 11/2002 | Burns et al. |
| 6,481,746 | B1 | | 11/2002 | Hinshaw et al. |
| 6,689,237 | B1 | * | 2/2004 | Mendenhall ..... 149/36 |
| 2004/0200554 | A1 | * | 10/2004 | Mendenhall et al. ..... 149/36 |

FOREIGN PATENT DOCUMENTS

| | | |
|---|---|---|
| WO | 95/04015 | 2/1995 |
| WO | 98/22208 | 5/1998 |
| WO | 01/38266 | 5/2001 |

* cited by examiner

*Primary Examiner*—Francis T. Palo
(74) *Attorney, Agent, or Firm*—Sally J. Brown

(57) ABSTRACT

A material for a pyrotechnic composition and related pyrotechnic compositions are provided in which the material includes a substituted basic metal nitrate including a reaction product of an acidic organic compound and a basic metal nitrate. A method for enhancing a burn rate of a gas generant composition and a burn rate enhanced gas generant composition including a reaction product of basic metal nitrate and tetrazoles, tetrazole derivatives, and combinations thereof, and a nitrogen-containing co-fuel such as guanidine nitrate are also disclosed. The burn rate enhance gas generant composition may optionally include an additional oxidizer such as basic copper nitrate.

34 Claims, No Drawings

SUBSTITUTED BASIC METAL NITRATES IN GAS GENERATION

BACKGROUND OF THE INVENTION

This invention relates generally to a material for use in gas generation such as for forming an inflation gas for inflating inflatable devices such as airbag cushions included in automobile inflatable restraint systems. In particular, the invention relates to a material including a substituted basic metal nitrate compound that includes a reaction product of an acidic organic compound and a basic metal nitrate.

It is generally well known to protect a vehicle occupant using a cushion or bag, e.g., an "airbag cushion" that is inflated or expanded with a gas when a vehicle experiences sudden deceleration, such as in the event of a collision. Such airbag restraint systems normally include: one or more airbag cushions, housed in an uninflated and folded condition to minimize space requirements; one or more crash sensors mounted on or to the frame or body of the vehicle to detect sudden deceleration of the vehicle; an activation system electronically triggered by the crash sensors; and inflator device that produces or supplies a gas to inflate the airbag cushion. In the event of a sudden deceleration of the vehicle, the crash sensors trigger the activation system which in turn triggers the inflator device which begins to inflate the airbag cushion in a matter of milliseconds.

Many types of inflator devices have been disclosed in the art for inflating one or more inflatable restraint system airbag cushions. Generally, such inflator devices may include one or more pyrotechnic compositions such as an igniter composition, the combustion of which may ignite a gas generating compound, or a gas generant composition, the combustion of which provides a gas such as may be used either alone or to supplement a stored and pressurized gas to inflate an associated airbag cushion.

Pyrotechnic compositions such as gas generant compositions commonly utilized in the inflator devices of automobile inflatable restraint systems have previously most typically employed or been based on sodium azide. Such sodium azide-based compositions upon initiation normally produce or form nitrogen gas typically at desirably high gas yields, e.g., greater than 2 moles/100 grams composition. While the use of sodium azide and certain other azide-base pyrotechnic materials meets current industry specifications, guidelines and standards, such use may involve or raise potential concerns such as involving safe and effective handling, supply and disposal of such azide-based pyrotechnic materials.

As a result, the development and use of other suitable pyrotechnic compositions has been pursued. In particular, such efforts have been directed to the development of azide-free pyrotechnic compositions for use in such inflator devices. Much research has gone into the identification and evaluation of non-azide or azide-free pyrotechnic formulations or compositions that provide: a high gas output, typically greater than about 2 moles of gas per 100 grams of pyrotechnic composition; a low combustion temperature such as less than 2000 K; a high burn rate, generally greater than about 0.5 inches per second at 1000 psi; low toxicity of effluent gases; and easily filterable particulate matter. Typically such azide-free formulations are less toxic and therefore easier to dispose of and more accepted by the general public.

Unfortunately, such formulations often have or exhibit burn rates that are generally lower than is desired or optimal to provide efficient and effective inflation of an associated airbag cushion. For some inflator device applications a low burn rate can be compensated for by using small particles of pyrotechnic composition having a relatively large surface area. However, in practice there are limits on the minimum size of pyrotechnic composition particles that can be reproducibly manufactured. Additionally, a higher burn rate than can be achieved with such pyrotechnic compositions may be desired for inflator programs requiring higher performance.

The burn rates of certain pyrotechnic compositions, particularly those including nitrogen-containing fuels, have been enhanced variously through the inclusion of one or more selected additives such as a selected high energy fuel ingredient or by the addition of co-oxidizers such as ammonium and potassium perchlorate. However, use of such materials may add expense to the manufacture of the pyrotechnic compositions such as via increased raw material costs and added process steps. Moreover, certain economic and design considerations such as industry competition has led to a desire for pyrotechnic compositions which are composed of less costly ingredients or materials and which are amenable to processing via more efficient or less costly techniques.

In view of the above, there is a need and a demand for a non-azide or azide-free pyrotechnic material or composition that, while overcoming at least some of the potential problems or shortcomings of azide-based pyrotechnic compositions, may also provide relatively high gas yields as compared to typical azide-based pyrotechnic compositions. There is a further need and a demand for a material that may be utilized in a pyrotechnic composition which provides or results in a sufficient and desirably high burn rate such as a burn rate of greater than about 0.5 inches per second at 1000 psi. There is a still further need or a demand for a pyrotechnic composition including a burn rate enhancing material that may be economically and efficiently manufactured.

SUMMARY OF THE INVENTION

A general object of the invention is to provide a material for use in a pyrotechnic composition.

A more specific objective of the invention is to overcome one or more of the problems described above.

The general object of the invention can be attained, at least in part, through a material for use in a pyrotechnic composition including a substituted basic metal nitrate which includes a reaction product of an acidic organic compound and a basic metal nitrate.

The prior art generally fails to disclose such substituted basic metal nitrates. In particular, the prior art fails to disclose that non-azide or azide-free materials having an acidic hydrogen may be reacted with basic metal nitrates to partially replace hydroxyl groups in the basic metal nitrate without disrupting the structure of the basic metal nitrate. The prior art further generally fails to recognize or disclose the burn rate enhancing properties of such materials when utilized in a pyrotechnic composition.

The invention further comprehends a burn rate enhanced gas generant composition including:

- about 5 to about 95 composition weight percent substituted basic copper nitrate, the substituted basic copper nitrate including a reaction product of an acidic organic compound and basic copper nitrate; and
- about 5 to about 60 composition weight percent guanidine nitrate co-fuel,
- wherein the acidic organic compound is selected from the group consisting of tetrazoles, tetrazole derivatives, and combinations thereof.

The invention still further comprehends a method of increasing a burn rate of a gas generant composition including adding a substituted basic metal nitrate to the gas generant composition.

As used herein, references to a "burn rate enhanced" material are to be understood to refer to materials or compositions which exhibit a burn rate of at least 0.5 inches per second at 1000 pounds per square inch (psi) or greater.

Other objects and advantages will be apparent to those skilled in the art from the following detailed description taken in conjunction with the appended claims.

DETAILED DESCRIPTION OF THE INVENTION

The present invention provides a material such as for use in or as a pyrotechnic composition used in the inflation of inflatable elements such as an airbag cushion of an automobile inflatable restraint system. Such material includes a substituted basic metal nitrate including a reaction product of an acidic organic compound and a basic metal nitrate.

In accordance with the invention, non-azide or azide-free materials having an acidic hydrogen will react with a basic metal nitrate such as basic copper nitrate and partially replace the hydroxyl groups in the basic metal nitrate without liberating soluble metal nitrate. In other words, the structural integrity of the basic metal nitrate is not compromised by the substitution reaction.

In accordance with certain preferred embodiments of the invention, the material used in the practice of the invention desirably includes a substituted basic metal nitrate including a reaction product of an acidic organic compound and a basic metal nitrate. Suitably, the acidic organic compound is a nitrogen-containing heterocyclic compound including an acidic hydrogen.

Examples of suitable acidic organic compounds includes, but are not limited to, tetrazoles, imidazoles, imidazolidinone, triazoles, urazole, uracil, barbituric acid, orotic acid, creatinine, uric acid, hydantoin, pyrazoles, derivatives thereof, and combinations thereof. Particularly suitable acidic organic compounds include tetrazoles, imidazoles, derivatives thereof, and combinations thereof. Examples of such acidic organic compounds include 5-amino tetrazole, bitetrazole dihydrate, and nitroimidazole. In certain preferred embodiments, the acidic organic compound includes 5-amino tetrazole.

Generally, basic metal nitrate compounds utilized in certain embodiments of the invention include basic metal nitrates, basic transition metal nitrate hydroxy double salts, basic transition metal nitrate layered double hydroxides, and combinations thereof. Examples of basic metal nitrates include, but are not limited to, basic copper nitrate, basic zinc nitrate, basic cobalt nitrate, basic iron nitrate, basic manganese nitrate and combinations thereof. In accordance with certain preferred embodiments, the basic metal nitrate includes basic copper nitrate.

A few representative substitution reactions, such as reactions (1) through (4) below, and substituted basic metal nitrate reaction products, particularly, 5-amino tetrazole substituted basic copper nitrate, bitetrazole dihydrate substituted basic copper nitrate, and nitroimidazole substituted basic copper nitrate, within the scope of the present are as follows:

(1) $3Cu(OH)_2 \cdot Cu(NO_3)_2 + 2CH_3N_5 \rightarrow 2Cu(OH)_2 \cdot Cu(CH_2N_5)_2 \cdot Cu(NO_3)_2 + 2H_2O$;

(2) $3Cu(OH)_2 \cdot Cu(NO_3)_2 + C_2H_2N_8 \cdot 2H_2O \rightarrow 2Cu(OH)_2 \cdot Cu(NO_3)_2 + 4H_2O$;

(3) $3Cu(OH)_2 \cdot Cu(NO_3)_2 + 2C_3H_3N_3O_2 \rightarrow 2Cu(OH)_2 \cdot Cu(C_3H_2N_3O_2)_2 \cdot Cu(NO_3)_2 + 2H_2O$; and (4) $3Cu(OH)_2 \cdot Cu(NO_3)_2 + 4C_3H_3N_3O_2 \rightarrow Cu(OH)_2 \cdot 2Cu(C_3H_2N_3O_2)_2 \cdot Cu(NO_3)_2 + 4H_2O$.

In one aspect of the invention, the described substituted basic metal nitrate materials may be utilized as a pyrotechnic composition such as may be included in an inflator device of an automobile inflatable restraint system. In another aspect, the described substituted basic metal nitrate materials may be used in a pyrotechnic composition such as an igniter composition or a gas generant composition including additional components such as a co-fuel. In accordance with certain preferred embodiments, the substituted basic metal nitrate used in the practice of the invention desirably enhances the burn rate of an associated gas generant composition.

Generally, such pyrotechnic compositions include a substituted basic metal nitrate and a nitrogen containing co-fuel. In particular, such burn rate enhanced gas generant compositions include a reaction product of a basic metal nitrate such as basic copper, zinc, cobalt, iron and manganese nitrates, basic transition metal nitrate hydroxy double salts, basic transition metal nitrate layered double hydroxides, and combinations thereof and an acidic organic material such as tetrazoles, tetrazole derivatives, and combinations thereof.

Typically, the pyrotechnic compositions of the invention may advantageously include about 5 to about 95 composition weight percent of the substituted basic metal nitrate. For example, a burn rate enhanced gas generant composition of the invention may include about 5 to about 95 composition weight percent 5-amino tetrazole substituted basic copper nitrate.

In practice, the pyrotechnic compositions of the invention may desirably include about 5 to about 60 composition weight percent co-fuel. One particularly preferred pyrotechnic composition includes about 5 to about 60 composition weight percent guanidine nitrate co-fuel. The desirability of use of guanidine nitrate in the pyrotechnic compositions of the invention is generally based on a combination of factors such as relating to cost, stability (e.g., thermal stability), availability and compatibility (e.g., compatibility with other standard or useful pyrotechnic composition components, for example).

If desired, a pyrotechnic composition in accordance with the invention may advantageously include an additional oxidizer in an amount of up to about 50 composition weight percent. In one embodiment, the preferred additional oxidizer includes a basic metal nitrate such as basic copper nitrate.

Additional additives such as slag forming agents, flow aids, viscosity modifiers, pressing aids, dispersing aids, or phlegmatizing agents may also be included in the pyrotechnic composition to facilitate processing or to provide enhanced properties. For example, pyrotechnic compositions in accordance with the invention may include a slag forming agent such as a metal oxide compound such as aluminum oxide. Generally, such additives may be included in the igniter composition in an amount of no more than about 5 composition weight percent.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

EXAMPLES

Examples 1–4

A 5-amino tetrazole substituted basic copper nitrate such as formed by representative substitution reaction (1) above was prepared by dissolving 2.24 grams (g) of 5-amino tetrazole (enough to replace four hydroxyl groups in the basic copper nitrate) in 50 milliliters (ml) of hot water to form a 5-amino tetrazole solution. Basic copper nitrate in an amount of 3.20 g was added slowly to the 5-amino tetrazole solution. The reaction between the basic copper nitrate and the 5-amino tetrazole occurred within about 5 to about 10 minutes, forming an water-insoluble green precipitate. The precipitate was collected and washed with copious amounts of water to remove any free 5-amino tetrazole present. The washed precipitate was dried at 80° C. for about 2 hours and submitted for chemical and thermal analysis. The experimental yield of the dried precipitate was 3.81 g. The theoretical yield assuming replacement of two hydroxyl groups is 4.09 g. The results of the chemical analysis are included in TABLE 1 below.

TABLE 1

| Assay | Theoretical | Observed |
|---|---|---|
| % Copper | 41.39 | 40.03 |
| % Carbon | 3.91 | 3.92 |
| % Hydrogen | 1.30 | 1.57 |
| % Nitrogen | 27.35 | 27.08 |

The chemical analysis shows good agreement between the observed and the theoretical composition. The observed mono-substituted reaction product appears to be the preferred reaction product since an excess of 5-amino tetrazole in the reaction mixture failed to increase the degree of substitution.

Similar data can be shown for bitetrazole dihydrate substituted basic copper nitrate and nitroimidazole substituted basic copper nitrate such as may be formed by representative substitution reactions (2) through (4) above. The interesting observation in the experiment shown in representative reaction (2) above is that if more than two equivalents of bitetrazole dihydrate are used in the reaction, the structure of the basic copper nitrate is upset and the reaction products include copper bitetrazole and copper nitrate. Representative reactions (3) and (4) above demonstrate that either two or four equivalents of nitroimidazole can react with the basic metal nitrate without disrupting the inherent structure of the basic metal nitrate.

Examples 5–9

TABLE 2, below, provides the compositional make-up of one comparative gas generant composition (CE) and five specific gas generant compositions (Example 5 through Example 9) including the 5-amino tetrazole substituted basic copper nitrate (ATbCN) of Example 1 in accordance with the invention. TABLE 2 also identifies the equivalence ratio, gas yield, burn rate at 1000 psi and density for each gas generant composition.

TABLE 2

| | CE | Example 5 | Example 6 | Example 7 | Example 8 | Example 9 |
|---|---|---|---|---|---|---|
| % Guanidine nitrate | 52.53 | 44.47 | 36.29 | 27.89 | 19.23 | 16.29 |
| % Basic copper nitrate | 45.97 | 35.76 | 25.27 | 14.60 | 3.75 | 0.00 |
| % ATbCN* | 0.00 | 18.25 | 36.91 | 55.96 | 75.45 | 82.21 |
| % Aluminum oxide | 1.50 | 1.52 | 1.53 | 1.55 | 1.57 | 1.50 |

TABLE 2-continued

| | CE | Example 5 | Example 6 | Example 7 | Example 8 | Example 9 |
|---|---|---|---|---|---|---|
| Equivalence ratio | 1.00 | 1.00 | 1.00 | 1.00 | 1.00 | 1.00 |
| Gas yield (moles/100 g) | 2.97 | 2.84 | 2.72 | 2.59 | 2.45 | 2.41 |
| Burn rate @ 1000 psi (inches/sec) | 0.43 | 0.61 | 0.83 | 1.17 | 1.76 | 1.88 |
| Density (g/cc) | 1.92 | 2.00 | 2.04 | 2.08 | 2.09 | 2.06 |

*ATbCN = 5-amino tetrazole substituted basic copper nitrate.

As shown in TABLE 2 above, 5-amino tetrazole substituted basic copper nitrate is a potent burn rate enhancer. The data shows that increasing the 5-amino tetrazole substituted basic copper nitrate in the mix increase the burn rate of the mix. Burn rates of the magnitude obtained in this experiment would allow a cost reduction in the processing of gas generant compositions into tablets or wafers since fewer, thicker tablets or wafers would provide equivalent performance to gas generants without the substituted basic metal nitrate. Additionally, the particle size limitation discussed above would be overcome via the use of thicker tablets or wafers that provide equivalent or enhanced burn rates.

It is to be understood that the discussion of theory, such as the discussion of the substitution reaction of the acidic organic compound and the basic metal nitrate, for example, is included to assist in the understanding of the subject invention and is in no way limiting to the invention in its broad application.

Thus, the invention provides a material for use in a pyrotechnic composition that includes a substituted basic metal nitrate. Additionally, the invention provides pyrotechnic compositions including a reaction product of an acidic organic compound and basic metal nitrate. The invention further provides a method for enhancing the burn rate of a gas generant composition and a burn rate enhanced gas generant composition including a reaction product of a basic metal nitrate and an acidic organic compound such as tetrazoles, tetrazole derivatives, and combinations thereof, and a nitrogen-containing co-fuel. The invention still further provides pyrotechnic compositions that are economical to manufacture. The invention additionally provides a burn rate enhanced gas generant composition that overcomes one or more of the limitations of non-azide or azide-free gas generant compositions such as particle size.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A material for use in a pyrotechnic composition comprising:

a substituted basic metal nitrate;

wherein the substituted basic metal nitrate includes a reaction product of an acidic organic compound and a basic metal nitrate.

2. The material of claim 1 wherein the acidic organic compound is a nitrogen-containing heterocyclic compound including an acidic hydrogen.

3. The material of claim 1 wherein the acidic organic compound is selected from the group consisting of tetrazoles, imidazoles, imidiazolidinone, triazoles, urazole, uracil, barbituric acid, orotic acid, creatinine, uric acid, hydantoin, pyrazoles, derivatives thereof, and combinations thereof.

4. The material of claim 1 wherein the acidic organic compound is selected from the group consisting of tetrazoles, imidazoles, derivatives thereof, and combinations thereof.

5. The material of claim 1 wherein the acidic organic compound comprises 5-amino tetrazole.

6. The material of claim 1 wherein the acidic organic compound comprises bitetrazole dihydrate.

7. The material of claim 1 wherein the acidic organic compound comprises nitroimidazole.

8. The material of claim 1 wherein the basic metal nitrate is selected from the group consisting of basic copper, zinc, cobalt, iron, and manganese nitrates, basic transition metal nitrate hydroxy double salts, basic transition metal nitrate layered double hydroxides, and combinations thereof.

9. The material of claim 1 wherein the basic metal nitrate comprises basic copper nitrate.

10. The material of claim 1 wherein the substituted basic metal nitrate comprises $2Cu(OH)_2 \cdot Cu(CH_2N_5)_2 \cdot Cu(NO_3)_2$.

11. The material of claim 1 wherein the substituted basic metal nitrate comprises $2Cu(OH)_2 \cdot Cu(C_2N_8) \cdot Cu(NO_3)_2$.

12. The material of claim 1 wherein the substituted basic metal nitrate comprises $2Cu(OH)_2 \cdot Cu(C_3H_2N_3O_2)_2 \cdot Cu(NO_3)_2$.

13. A pyrotechnic composition consisting essentially of the material of claim 1.

14. The pyrotechnic composition of claim 13 wherein the acidic organic compound is a nitrogen-containing heterocyclic compound containing an acidic hydrogen.

15. The pyrotechnic composition of claim 13 wherein the acidic organic compound is selected from the group consisting of tetrazoles, imidazoles, derivatives thereof, and combinations thereof.

16. The pyrotechnic composition of claim 13 wherein the basic metal nitrate comprises basic copper nitrate.

17. The pyrotechnic composition of claim 13 wherein the substituted basic metal nitrate is selected from the group consisting of 5-amino tetrazole substituted basic copper nitrate, bitetrazole dihydrate substituted basic copper nitrate, nitroimidazole substituted basic copper nitrate.

18. A burn rate enhanced gas generant composition comprising:

the material of claim 1; and a nitrogen containing co-fuel, wherein the acidic organic compound is selected from the group consisting of tetrazoles, tetrazole derivatives, and combinations thereof.

19. The burn rate enhanced gas generant composition of claim 18 wherein the basic metal nitrate is selected from the group consisting of basic copper, zinc, cobalt, iron, and manganese nitrates, basic transition metal nitrate hydroxy double salts, basic transition metal nitrate layered double hydroxides, and combinations thereof.

20. The burn rate enhanced gas generant composition of claim 18 wherein the substituted basic metal nitrate fuel comprises 5-amino tetrazole substituted basic copper nitrate.

21. The burn rate enhanced gas generant composition of claim 18 wherein the nitrogen containing co-fuel comprises guanidine nitrate.

22. The burn rate enhance gas generant composition of claim 18 comprising:

about 5 to about 95 composition weight percent of the substituted basic metal nitrate; and about 5 to about 60 composition weight percent of the nitrogen-containing co-fuel.

23. The burn rate enhanced gas generant composition of claim 18 further comprising an additional oxidizer.

24. The burn rate enhanced gas generant composition of claim 23 wherein the additional oxidizer comprises a basic metal nitrate.

25. The burn rate enhanced gas generant composition of claim 24 wherein the additional oxidizer comprises basic copper nitrate.

26. The burn rate enhanced gas generant composition of claim 23 wherein the additional oxidizer is present in an amount of up to about 50 composition weight percent.

27. A burn rate enhanced gas generant composition comprising:

about 5 to about 95 composition weight percent substituted basic copper nitrate, the substituted basic copper nitrate including a reaction product of an acidic organic compound and a basic copper nitrate; and about 5 to about 60 composition weight percent guanidine nitrate co-fuel, wherein the acidic organic compound is selected from the group consisting of tetrazoles, tetrazole derivatives, and combinations thereof.

28. The burn rate enhanced gas generant composition of claim 27 wherein the substituted basic copper nitrate comprises 5-amino tetrazole substituted basic copper nitrate.

29. The burn rate enhanced gas generant composition of claim 27 further comprising basic copper nitrate additional oxidizer in an amount of up to about 50 composition weight percent.

30. A method of increasing a burn rate of a gas generant composition, the method comprising:

adding the substituted basic metal nitrate of claim 1 to the gas generant composition.

31. The method of claim 30 further comprising:

combining an acidic organic compound with a basic metal nitrate; and forming a reaction product including the substituted basic metal nitrate.

32. The method of claim 31 wherein the acidic organic compound is selected from the group consisting of tetrazoles, tetrazole derivatives, and combinations thereof.

33. The method of claim 32 wherein the basic metal nitrate compound is selected from the group consisting of copper, zinc, cobalt, iron and manganese nitrates, basic metal nitrate hydroxy double salts, basic metal nitrate layered double hydroxides, and combinations thereof.

34. The method of claim 30 wherein the substituted basic metal nitrate comprises 5-amino tetrazole substituted basic copper nitrate.

* * * * *